United States Patent [19]

Charvat

[11] 4,216,370

[45] Aug. 5, 1980

[54] ELECTRIC COUNTERTOP COOKING APPLIANCE

[75] Inventor: Charles J. Charvat, Holcombe, Wis.

[73] Assignee: McGraw-Edison Company, Elgin, Ill.

[21] Appl. No.: 825,203

[22] Filed: Aug. 17, 1977

Related U.S. Application Data

[63] Continuation of Ser. No. 724,321, Sep. 17, 1976, abandoned.

[51] Int. Cl.[2] ..... H05B 3/68; A47S 37/08

[52] U.S. Cl. ..... 219/460; 219/464; 219/433; 219/400; 99/487

[58] Field of Search ..... 219/432, 433, 461, 464, 219/455, 400, 454, 446, 460, 449, 10.55 R; 99/487; 174/16 R, 15 R

[56] References Cited

U.S. PATENT DOCUMENTS

| | | | |
|---|---|---|---|
| 2,238,402 | 4/1941 | Smith | 219/446 |
| 2,715,173 | 8/1955 | Faruharson | 219/460 |
| 2,734,983 | 2/1956 | Krichton | 219/465 X |
| 3,167,688 | 1/1965 | Hein | 174/16 R |
| 3,443,063 | 5/1969 | Berger et al. | 219/400 X |
| 3,738,256 | 6/1973 | Joeckel | 219/460 |
| 3,797,375 | 3/1974 | Cerola | 219/460 |
| 3,870,862 | 3/1975 | Doner | 219/460 |
| 3,940,665 | 2/1976 | Seki | 174/16 R |

*Primary Examiner*—Bruce A. Reynolds
*Assistant Examiner*—M. H. Paschall
*Attorney, Agent, or Firm*—Dale A. Kubly; Jon C. Gealow; Ronald J. LaPorte

[57] ABSTRACT

An improved electric cooking appliance such as a hot plate, range or griddle, particularly for use in a commercial countertop application. This class of appliance has a case supporting an electric heating element and the space between the heating element and the bottom of the case is limited because of the height restrictions of the counter type appliance. The improved appliance has a baffle extending across the entire breadth of the case below the heating element and separating the case into the heating element compartment on the upper side of the baffle and the control compartment located on the lower side. The controls including a switch or the like are located in the lower compartment and thereby are separated from the heating element by this baffle. Both the heating element compartment and the control compartment are provided with openings in the case at opposite sides of the compartment to allow convective airflow cooling of the compartment.

11 Claims, 4 Drawing Figures

ELECTRIC COUNTERTOP COOKING APPLIANCE

This is a continuation of application Ser. No. 724,321, filed Sept. 17, 1976, now adandoned.

BACKGROUND OF INVENTION

In the commercial or restaurant food cooking art, there is what is known as a countertop appliance, where such appliance is designed to sit on top of a table or counter. These appliances are rather compact vertically, and in food cooking appliances such as hot plates, ranges or griddles of this general construction, the spacing between the hot electric heating elements and the controls for the heating elements is restricted. Because devices of this type frequently are used continuously, or are at least energized on a continuous basis during the opening hours of the restaurant or commercial food establishment, there is a tendency for the controls to be in an excessively hot environment for extended periods of time. Such exposure on a continuing basis commonly causes a malfunctioning of the controls or at least shortens the expected operating life thereof.

SUMMARY OF INVENTION

This invention relates to a countertop cooking appliance such as a hot plate, range or griddle, and specifically to means for maintaining the controls therefor within a cool operating environment even during continuous or sustained use.

Specifically, the invention provides for a case, heating elements in the case, a baffle supported by the case underlying the heating elements, and controls mounted on the case underlying the baffle. This structure thereby defines separated compartments exposed respectively to the heating element structure and to the controls. Each of the compartments has inlet and outlet openings to allow air to flow through the compartments for cooling the same.

The appliance on the food cooking line would normally have the front exposed to the ambient air and the back exposed to a wall, so that the front air normally would be cooler than the back air to convectively flow through the respective compartments in a front to rear direction. The case further has a top front lip that overlies the plane of the remaining front wall, and inlet vent openings can be formed in the underlying wall of this lip for ventilating the heating element compartment.

DETAILED DESCRIPTION OF THE INVENTION

Figure 1:
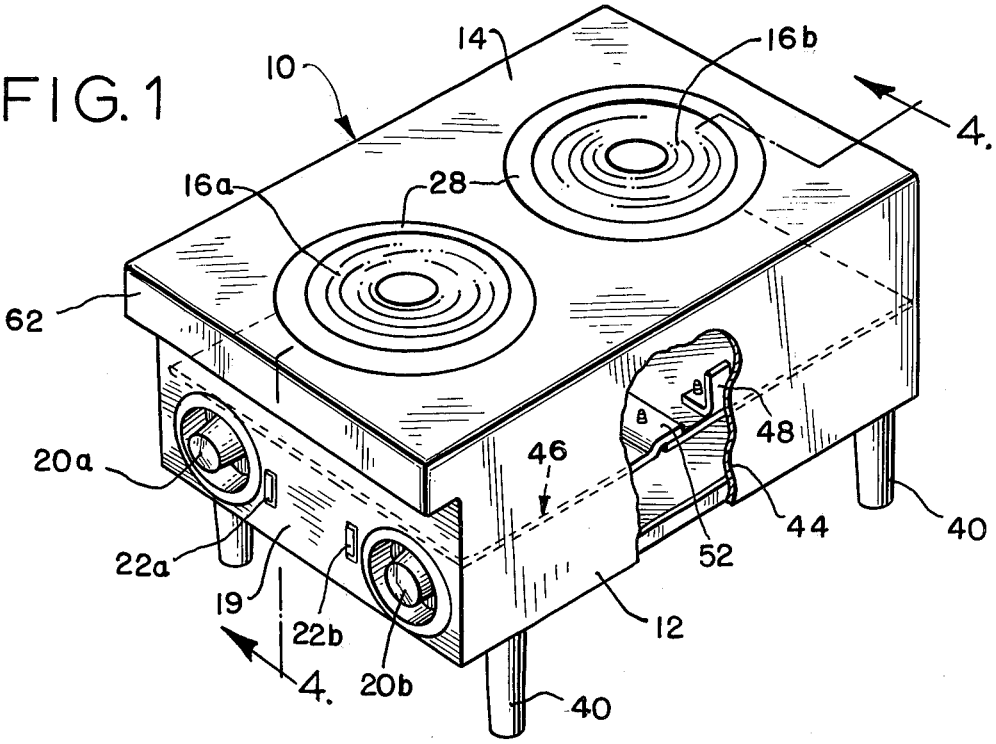
FIG. 1 is a perspective view showing an electric cooking device of the type for which this invention forms an improvement, and showing a preferred embodiment of the subject invention incorporated therein.
Figure 2:
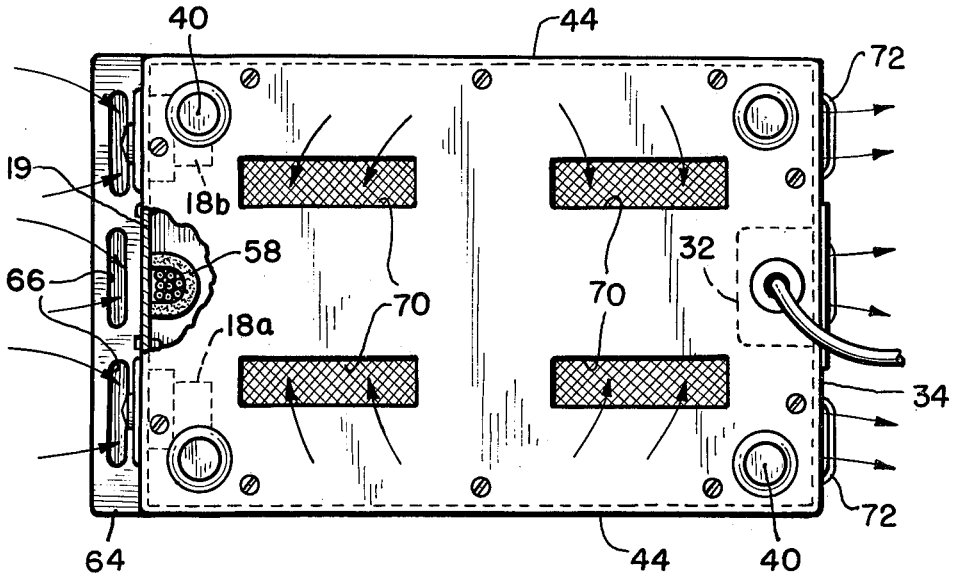
FIG. 2 is a bottom view of the appliance shown in FIG. 1, where part of the drawing is broken away for clarity of disclosure.
Figure 3:
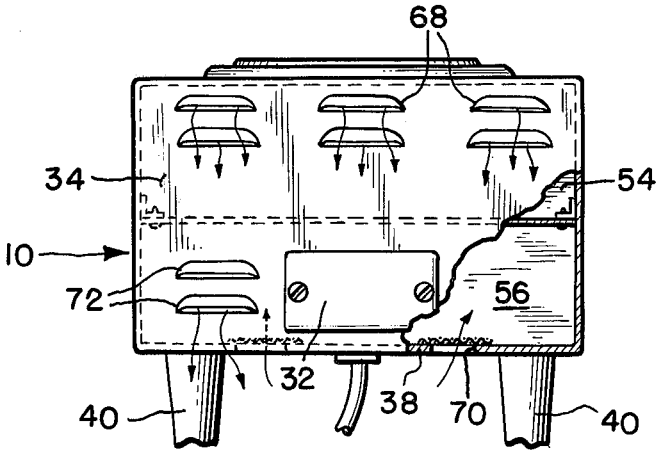
FIG. 3 is a rear elevational view of the appliance shown in FIG. 1, again where part of the view is broken away for clarity of disclosure.

FIG. 1 illustrates in perspective view a countertop appliance of the hot plate or range type typically used in commercial installations, such as in restaurants. The appliance 10 includes a case 12 of structural metal or the like which supports from the top wall 14 a pair of heating elements **16*a* and 16*b*. A suitable control is provided for each heating element to allow the individual ccontrol thereof, and this is illustrated by the separate switches 18*a* and 18*b* being supported on the rear side of the front wall 19 and having respective control knobs 20*a* and 20*b* exposed on the front side of the front wall. Indicator lights 22*a* and 22*b*** likewise can be exposed on the front wall proximate the individual switch control knobs to be illuminated whenever the particular heating element is energized.

The hot plate arrangement is typical to those found in like art, and therefore each heating element would generally be in the form of a sheathed element shaped into a helix with a generally flat upper cooking surface and with the two end terminals 24 emerging at a common terminal location. The heating element cooperates with a reflector pan 26 removably supported relative to a snap-in ring 28 held in turn relative to the case top wall, so that the ring, the pan, and the heating element each can be readily inserted in place relative to the appliance or removed from the appliance for cleaning purposes or the like. In this regard, the pan has an opening 30 through which the terminals 24 on the heating element project and to which terminals suitable electrical wires can be connected.

There further is an electrical junction box 32 formed adjacent the rear wall 34 of the case, and electric wires 36 feed from this junction box to the control switches **18*a* and 18*b* and from there to the heating elements 16*a* and 16*b* for connection to the terminals 24**. In the embodiment shown, each switch is of the multiple position type whereby manual setting to the different positions gives a corresponding output of the heating element, up to the maximum.

The case has the top wall 14, and an opposing bottom wall 33 to which support legs 40 are connected and which maintain the bottom wall slightly elevated relative to the supporting surface 42 of the counter or table top. The front side wall 19 and rear side wall 34 are in opposed generally parallel relation to one another and these and opposing side walls 44 extend between and interconnect the top and bottom walls. Because of the height restriction encountered in table top appliances, there is only a limited distance between the heating elements and the control switches, of the order of several inches. In commercial installations, there is a great tendency on the part of the operator to leave the appliance energized throughout the whole working day so that heat buildup from the energized heating elements normally subjects the controls to a hot environment over extended periods of time. It is to this specific problem that the subject invention forms an improvement.

Figure 4:
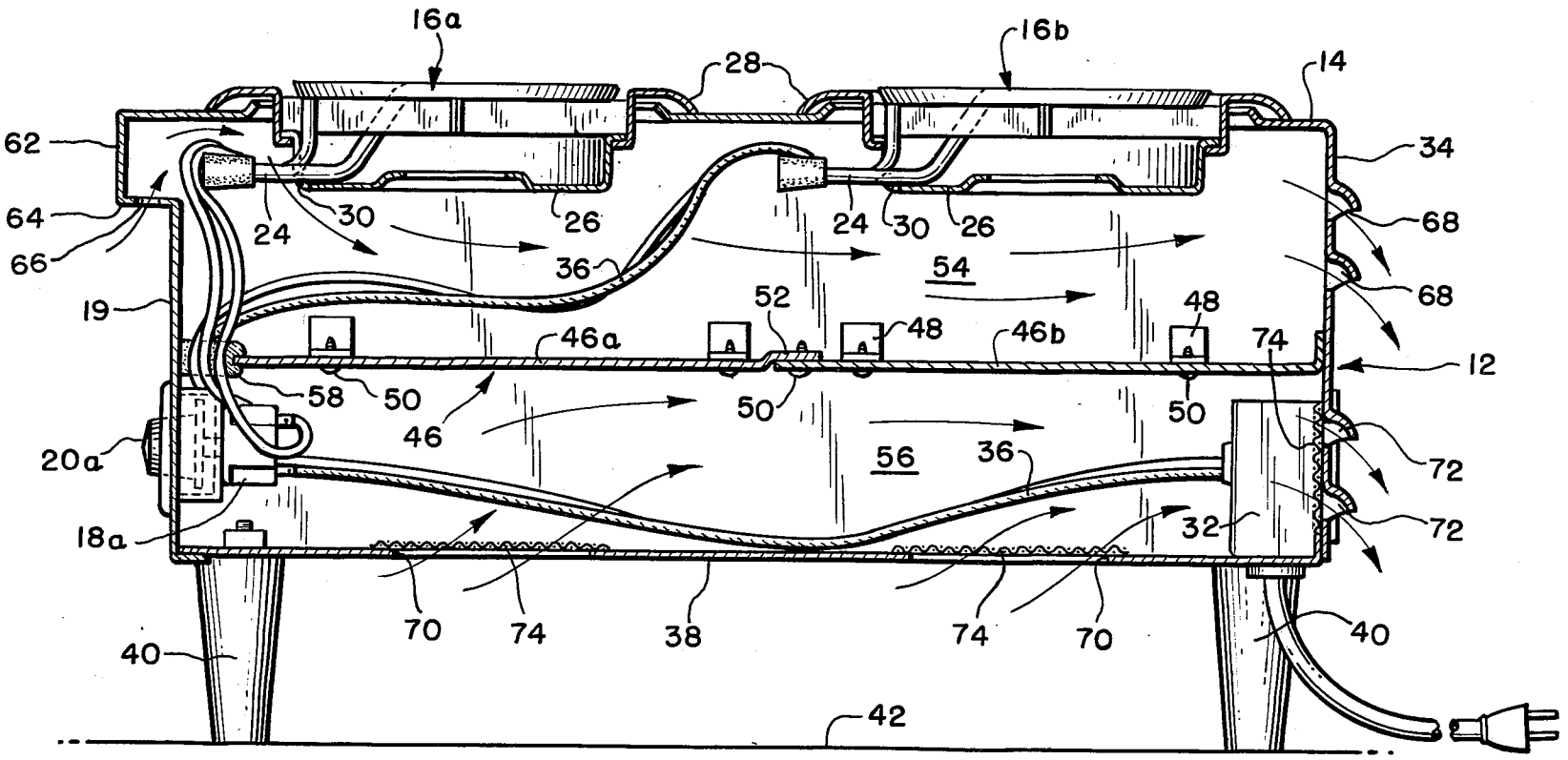
FIG. 4 is a sectional view, enlarged as compared to the other drawings, as seen generally from line 4—4 in FIG. 1.

FIG. 4 shows the imposition of a baffle 46 between the control switches and the heating elements, where the baffle extends the full breadth of the case between the front and rear walls and between the side walls. In the specific construction, L-shaped clips 48 spot welded to the side walls form seats against which the baffle abuts, and screws 50 threaded through openings in the baffle and into the clips thereby releasably secure the baffle in place relative to the case. In the preferred construction, the baffle is formed in two pieces 46a and 46b with an overlapping joint 52 again held together by screws 50. This multiple piece baffle construction increases the ease the appliance can be assembled when the various electrical and structural components are located in place, and further increases the ease with which the appliance can be serviced in the field.

The baffle 46 thus separates the case into two compartments, the upper compartment 54 being exposed to the heating elements and the lower compartment 56 being exposed to the control components. The wires 36, therefore, that extend between the control switches and the heating elements must pass through the baffle and in this regard there preferably is an annular grommet 58 of insulating material, such as ceramic, through which the wires extend, and the grommet is held in place relative to the baffle in a slot open to the baffle edge. This thereby protects the wires from edge contact with the baffle, while yet allows ready servicing of the unit by removal of the grommet merely upon disassembly of the baffle as above noted.

It is to be noted that the case has formed thereon a lip 62 projecting beyond the normal front wall, which defines thereby an underlying wall 64 that is below the eye level of anyone nearby and thus is normally hidden. This underlying wall has openings 66 therein which serve as inlets for cooling air passing through the upper heating element compartment 54, and the rear wall likewise has louvered openings 68 which serve as the outlets for such cooling air. The bottom wall 38 likewise has several openings 70 which serve as inlets for air to cool the lower control compartment 56, where again the rear wall has louvered outlet openings 72 for such cooling air.

The appliance in normal cooking operations is placed with the rear wall closer to a building wall or the like than is the front case wall. Therefore, the air at the rear wall openings is hotter than the air under or in front of the appliance to give convective airflow in a front to rear direction through the respective compartments. This baffling and airflow for cooling minimizes the temperature rise of air in the control compartment even after sustained use of the heating elements, and basically without the need for any thermal insulation. In this regard, the heat radiating off of the underside of the heating element assembly and particularly the pans 26 does not appreciably build up the temperature even in the upper heating element compartment with the cooling air passing threrethrough, so that the baffle 46 is maintained relatively cool. The airflow through the lower control compartment 56 maintains the temperature of air in the compartment relatively low, typically no higher than in the range between 130° and 160° F. In fact, because the temperature of air in the control compartment is maintained so cool in normal operation, it is necessary to put fine mesh screens 74 over the inlet and outlet openings to make the comparment rodent proof, again per the standards set by the regulating agencies of the industry.

What is claimed is:

1. An electric countertop cooking appliance adapted to be cooled by the flow of air therethrough, said appliance comprising:

a case having opposed top and bottom walls and interconnected side walls including opposed front and rear walls, said side walls extending between and interconnecting said top and bottom walls and said top wall having an opening therein; baffle plate means for dividing said case into upper and lower compartments and preventing the flow of air between said compartments, said baffle plate means extending within said case in spaced parallel relation with the top and bottom walls;

means including an electric heating element mounted in the opening in the top wall of said upper compartment for providing cooking heat;

means for energizing said heating element including control means mounted within the lower compartment on one of the walls of said case, said control means being electrically coupled to said heating element and having means extending through said one wall for operating said control means to control the heating element; and the case walls of said upper and lower compartments having respective air inlet openings for admitting air into said compartments and respective air outlet openings for discharging air from said compartments, said air inlet and outlet openings in each of said compartments being spaced apart and cooperating with said baffle plate means to induce a separate convectional cooling air flow through each of said compartments.

2. An electric countertop cooking appliance in accordance with claim 1 wherein the bottom wall of said case includes at least one opening comprising the air inlet opening of said lower compartment and including means for supporting said case in an elevated position to allow air to circulate below said bottom wall and enter said lower compartment through said lower compartment air inlet opening.

3. An electric countertop cooking appliance in accordance with claim 2 wherein said case supporting means comprises a plurality of support legs mounted to the bottom wall of said case.

4. An electric countertop cooking appliance in accordance with claim 2 wherein the rear wall of said case includes at least one louvered opening comprising the air outlet opening of said lower compartment.

5. An electric countertop cooking appliance in accordance with claim 2 including wire screens secured to the case in overlying relation to the air inlet and outlet openings of said lower compartment.

6. An electric countertop cooking appliance in accordance with claim 1 wherein said front wall includes a forwardly projecting lip portion opening interiorly to the upper compartment of said case, said lip portion including an underlying wall having at least one opening therein comprising the air inlet opening of said upper compartment.

7. An electric countertop cooking appliance in accordance with claim 1 wherein the rear wall of said case includes at least one louvered opening comprising the air outlet opening of said upper compartment.

8. An electric countertop cooking appliance in accordance with claim 1 including an annular grommet, said baffle plate means having a slot therein for receiving and holding said grommet, and including wires extending through said grommet to electrically couple said control means to said heating element.

9. An electric countertop cooking appliance in accordance with claim 1 wherein said baffle plate means comprises first and second plates and means for removably mounting said plates to the side walls of said case, said first plate having an edge portion adapted to overlap a portion of said second plate.

10. An electric countertop cooking appliance in accordance with claim 1 wherein the maximum temperature of the air in said lower compartment is in the range between about 130° Fahrenheit and about 160° Farenheit.

11. An electric countertop cooking appliance adapted to be cooled by the flow of air therethrough, said appliance comprising;

a case having opposed top and bottom walls and interconnected side walls including opposed front and rear walls, said side walls extending between and interconnecting said top and bottom walls and said top wall having an opening therein;

means for supporting said case in an elevated position to allow air to circulate below said bottom wall;

baffle plate means for dividing said case into upper and lower compartments and preventing the flow of air between said compartments, said baffle plate means extending within said case in spaced parallel relation with the top and bottom walls;

means including an electric heating element mounted in the opening in the top wall of said upper compartment for providing cooking heat;

means for energizing said heating element including control means mounted within the lower compartment on the front wall of said case, said control means having means extending through said front wall for operating said control means;

an annular grommet, said baffle plate means having a slot therein for receiving and holding said grommet;

means including wires extending through said grommet for electrically coupling said control means to said heating element, said control means controlling the energization of the heating element;

said front wall including a forwardly projecting lip portion opening interiorly to the upper compartment of said case, said lip portion including an underlying wall having at least one opening therein comprising an air inlet for admitting air into said upper compartment, the rear wall of the upper compartment of said case having at least one opening comprising an air outlet for discharging air from said upper compartment; and said bottom wall of said case having at least one opening comprising an air inlet for admitting air into said lower compartment and said rear wall of the lower compartment of said case having at least one opening for discharging air from said lower compartment, said air inlet and outlet openings of said compartments being spaced apart and cooperating with said baffle plate means to induce a separate convectional cooling air flow through each of said compartments.

* * * * *